US006556176B1

(12) United States Patent
Okuyama et al.

(10) Patent No.: US 6,556,176 B1
(45) Date of Patent: Apr. 29, 2003

(54) ACTIVE TYPE EL DISPLAY DEVICE CAPABLE OF DISPLAYING DIGITAL VIDEO SIGNAL

(75) Inventors: Masahiro Okuyama, Inazawa (JP); Naoaki Komiya, Ohgaki (JP)

(73) Assignee: Sanyo Electric Co., Ltd. (JP)

( * ) Notice: Subject to any disclaimer, the term of this patent is extended or adjusted under 35 U.S.C. 154(b) by 0 days.

(21) Appl. No.: 09/536,085

(22) Filed: Mar. 24, 2000

(30) Foreign Application Priority Data

Mar. 24, 1999 (JP) ..... 11-079729

(51) Int. Cl.[7] ..... G09G 3/30

(52) U.S. Cl. ..... 345/76; 345/77; 345/80; 345/74.1; 345/75.2; 315/169.3; 315/169.4

(58) Field of Search ..... 345/76, 77, 80, 345/74.1, 75.2; 315/169.3, 169.4

(56) References Cited

U.S. PATENT DOCUMENTS 5,448,258 A * 9/1995 Edwards ..... 345/90
5,652,600 A * 7/1997 Khormaei et al. ..... 345/76
5,714,968 A * 2/1998 Ikeda ..... 345/76
5,786,796 A * 7/1998 Takayama et al. ..... 345/76
5,990,629 A * 11/1999 Yamada et al. ..... 257/71
6,011,533 A * 1/2000 Aoki ..... 345/100
6,040,812 A * 3/2000 Lewis ..... 345/691

* cited by examiner

*Primary Examiner*—Amare Mengistu
*Assistant Examiner*—Jimmy H. Nguyen
(74) *Attorney, Agent, or Firm*—Cantor Colburn LLP

(57) ABSTRACT

There are provided a data register (8) for driving an EL element (6) by a current flowing in a data line (3) via a TFT (5) while sequentially capturing input digital video data for each data line, a latch circuit (10) for holding the data received in the data register (8) during 1 H period, and n analog switches (120 to 123) provided between each data line (3) and a power supply line (11), to which n bit of digital video data for each one data line is input bit by bit as each control signal. The transistors constituting each switch are made different sizes. As the current amount flowing in each switch therefore differs, the EL element emits light with a luminance in accordance with the digital video data.

13 Claims, 5 Drawing Sheets

ACTIVE TYPE EL DISPLAY DEVICE CAPABLE OF DISPLAYING DIGITAL VIDEO SIGNAL

BACKGROUND OF THE INVENTION

1. Field of the Invention

The present invention relates to an active type display device employing a thin film transistor (TFT) to drive an emissive element such as an organic electroluminescence (EL) element.

2. Description of Related Art

Organic EL elements are ideal for thin display configurations as they emit light and can eliminate need for a backlight as required in liquid crystal displays, and because they have unlimited viewing angles. Thus, wide application of organic EL elements is expected in the next generation of display devices.

As shown in an example in FIG. 1, an organic EL element 51 can be constituted by forming an anode 53 comprising a transparent electrode made of ITO (Indium Tin Oxide) or the like on a transparent glass substrate 52, and forming, between the anode 53 and a cathode 54 comprising an MgIn alloy, a hole-transport layer 55 comprising MTDATA (4,4',4"-tris(3-methylphenylphenylamino)triphenylamine), an emissive layer 56 comprising TPD (N,N'-diphenyl-N,N'-di(3-methylphenyl)-1,1'-biphenyl-4,4'-diamine) and Rubrene, and an electron-transport layer 57 comprising Alq3 (8-hydroxyquinoline aluminum), which are stacked in this order. Holes injected from the anode 53 and electrons injected from the cathode 54 are recombined within the emissive layer 56 to emit light, which is radiated outward from the transparent anode side in the direction shown in the figure.

Display devices employing an organic EL element configured as described above can be classified into a passive type having a simple matrix structure and an active type using TFTS. In the active type device, a circuit structure illustrated in FIG. 2 is employed for each pixel.

Referring to FIG. 2, numeral 70 indicates an organic EL element. A driver circuit corresponding to one pixel is constituted by a switching TFT 71 to be switched on and off according to a selection signal SCAN, in which a display signal DATA supplied from a data line 75 is applied to a drain and the selection signal from a selection signal line 76 is applied to a gate, a capacitor 72 connected between a source of the TFT 71 and a predetermined dc voltage Vsc, which is charged with a display signal supplied when the TFT 71 is ON and which holds a charging voltage VG when the TFT 71 is OFF, and a driving TFT 74 in which a drain is connected to a power source line 77 that supplies a drive power source voltage Vdd. A source is further connected to the anode of the organic EL element 70, and a hold voltage VG is supplied to a gate of the TFT 74 from the capacitor 72 to drive the organic EL element 70. In this example, the cathode of the organic EL element 70 is connected to a ground (GND) potential, and the drive power source voltage Vdd is set to a positive potential, 10V for example. Also, the voltage Vsc is of the same potential as Vdd or the ground (GND) potential.

In the above mentioned configuration, a voltage supplied from the data line 75 when the TFT 71 is ON is applied to the gate of the driving TFT 74, and a current in accordance with this voltage flows through the EL element 70 which then emits light.

Video signals can be classified into an analog signal and a digital signal. None of active type organic EL display devices have been heretofore applicable to a digital video signal. On the other hand, a liquid crystal display device applicable to a digital video signal is conventionally configured as shown in FIG. 3.

Specifically, digital video data D0 to D3 supplied from outside are captured in accordance with a shift clock from a shift register 30 into a data register 31, which latches the received data to a latch circuit 32. The digital data thus latched are then converted by a D/A converter 33 into an analog display signal, which is then supplied to a data line 34. To the data line 34, a drain of a TFT 36 which is opened and closed in accordance with a selection signal from a selection signal line 35 is connected. A pixel electrode 370 and a storage capacitor 38 are connected to a source of the TFT 36. A common electrode (371) faces the pixel electrode 370, and a liquid crystal 37 fills between both electrodes.

In the conventional liquid crystal display device to which a digital video signal is input, the driver circuit includes a D/A converter for converting a digital signal into an analog signal, as described above. For instance, when the bit number of digital data is 4, "16" stages of gray scale voltage (tone scale voltage) V0 to V15 are necessary for converting the digital data into an analog signal.

Therefore, in order to integrate the driver circuit within a display panel, the display panel must include terminals and wiring patterns for inputting as many as 16 stages of gray scale voltage V0 to V15, thereby failing to downsize the panel. Even if the driver circuit is configured as an IC, the number of terminals for the IC increases.

The same problem is found in an active type EL display device in which each pixel has a circuit structure such as shown in FIG. 2 and the EL element can be driven by a circuit similar to the driver circuit of FIG. 3.

SUMMARY OF THE INVENTION

The present invention was made to solve the aforementioned problem of the related art, and aims to provide an active type EL display device which, when a digital video signal is input thereto, does not need the gray scale voltage in accordance with the bit number of the digital data.

In accordance with one aspect of the present invention, there is provided an active matrix type emissive display device including, for each pixel, a thin film transistor to be opened and closed according to a selection signal and an emissive element connected to a data line via said thin film transistor for emitting light according to a supplied current, comprising n transistors for receiving, bit by bit, n bit input digital data sequentially captured for each data line and respectively outputting a different electrical current, wherein a current signal corresponding to a total current amount from said n transistors is output to a corresponding data line and is supplied to said emissive element via said thin film transistor.

In accordance with another aspect of the present invention, there is provided an active matrix type electroluminescence display device comprising an electroluminescence element connected to a data line via a thin film transistor to be opened and closed according to a selection signal, a data register for sequentially capturing input digital data for each data line, a latch circuit for holding the data received by said data register for a predetermined period, and n switches (n: an integer value greater than or equal to 2) to which n bit of digital data for each data line is input bit by bit as a control signal, each of said n switches supplying a different amount of electrical current.

In accordance with another aspect of the present invention, there is provided a driver circuit for an electroluminescence display device including, for each pixel, a thin film transistor to be opened and closed according to a selection signal and an electroluminescence element connected to a data line via said thin film transistor for emitting light according to supplied electrical current, said driver circuit comprising n transistors for capturing, bit by bit, n bit input digital data sequentially supplied for each data line and for respectively outputting a different amount of electrical current, wherein a signal corresponding to a total electrical current from said n transistors is output to a corresponding data line.

In accordance with still another aspect of the present invention, in a device or driver circuit as described above, each of said n transistors has a different size.

In accordance with still another aspect of the present invention, the emissive element referred to above is an organic electroluminescence element comprising an emissive layer containing an organic compound between an anode and a cathode.

In accordance with still another aspect of the present invention, the n transistors for outputting said current signal are formed on a substrate on which said organic electroluminecsence element and said thin film transistor are also formed.

According to the present invention, an active type emissive display device to which digital video data is input does not require a plurality of power sources respectively supplying a different analog gray scale voltage. Therefore, the number of input terminals and corresponding wiring patterns in a driver circuit can be reduced. When the driver circuit is integrated in the display panel, for example, the display panel can be downsized. Also, when the driver circuit is implemented as one chip (IC), the number of terminals of the IC can be decreased to thereby reduce the circuit scale.

Further, since a current signal in accordance with digital video data can be supplied, via a thin film transistor, to an emissive element such as an organic electroluminescence element to be driven by a supplied current, it is not necessary to convert a voltage signal in accordance with the digital video data into a current in a pixel portion, and thus effective drive of one emissive element by one thin film transistor can be implemented. The present invention is also applicable to a circuit configuration in which one emissive element is controlled by a plurality of thin film transistors within one pixel.

BRIEF DESCRIPTION OF THE DRAWINGS

These and other objects of the invention will be explained in the description below, in connection with the accompanying drawings, in which.

DETAILED DESCRIPTION OF THE PREFERRED EMBODIMENTS

Preferred embodiments of the present invention will be described in further detail with reference to the accompanying drawings.

Figure 4:
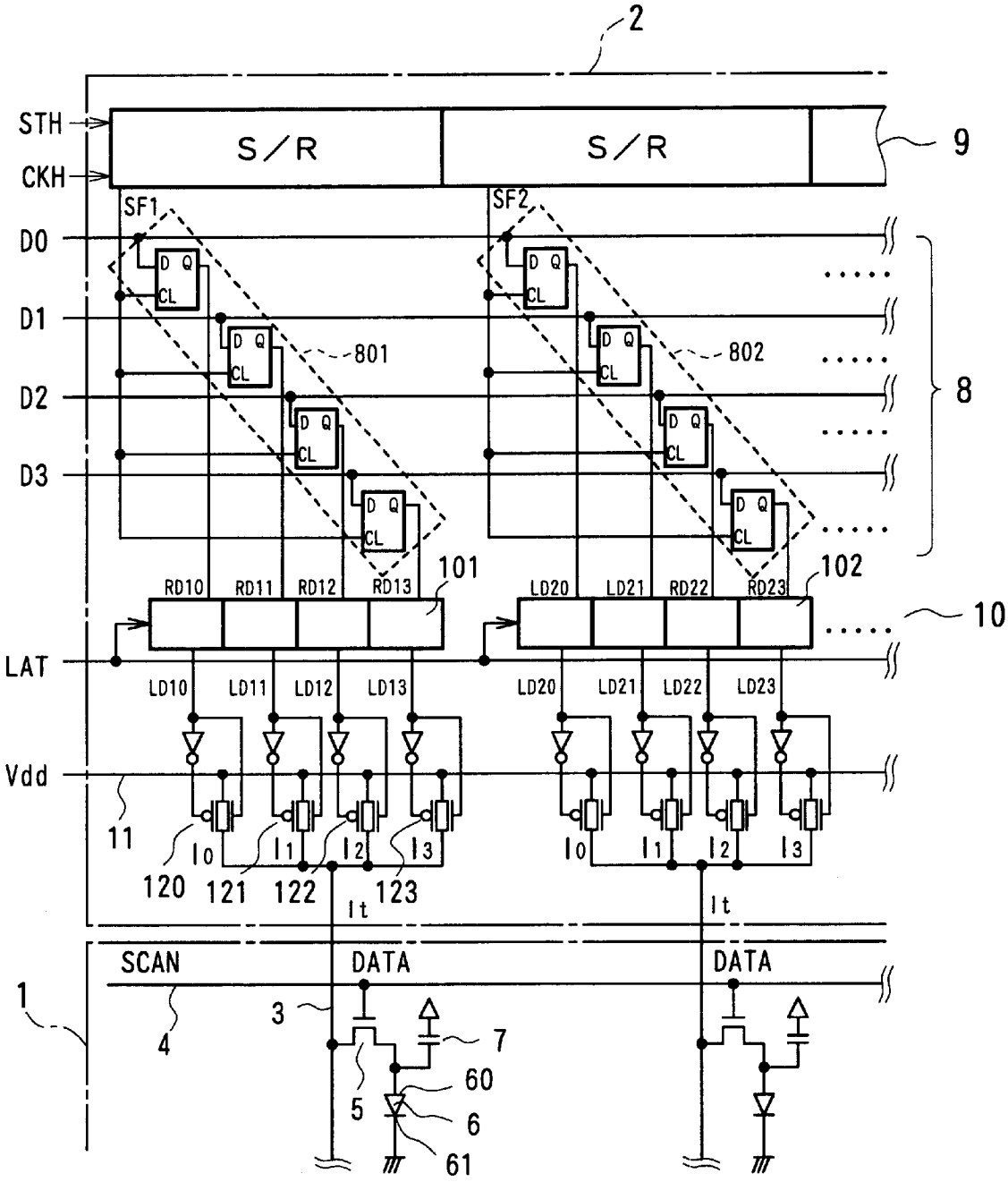
FIG. 4 is a block diagram showing a structure of an active type display device according to the present invention.

FIG. 4 is a block diagram showing one embodiment of an active type EL display device according to the present invention, in which numeral 1 denotes a pixel portion and numeral 2 denotes a driver circuit. In the shown example, the driver circuit 2 is integrated in a display panel including the pixel portion 1.

Figure 1:
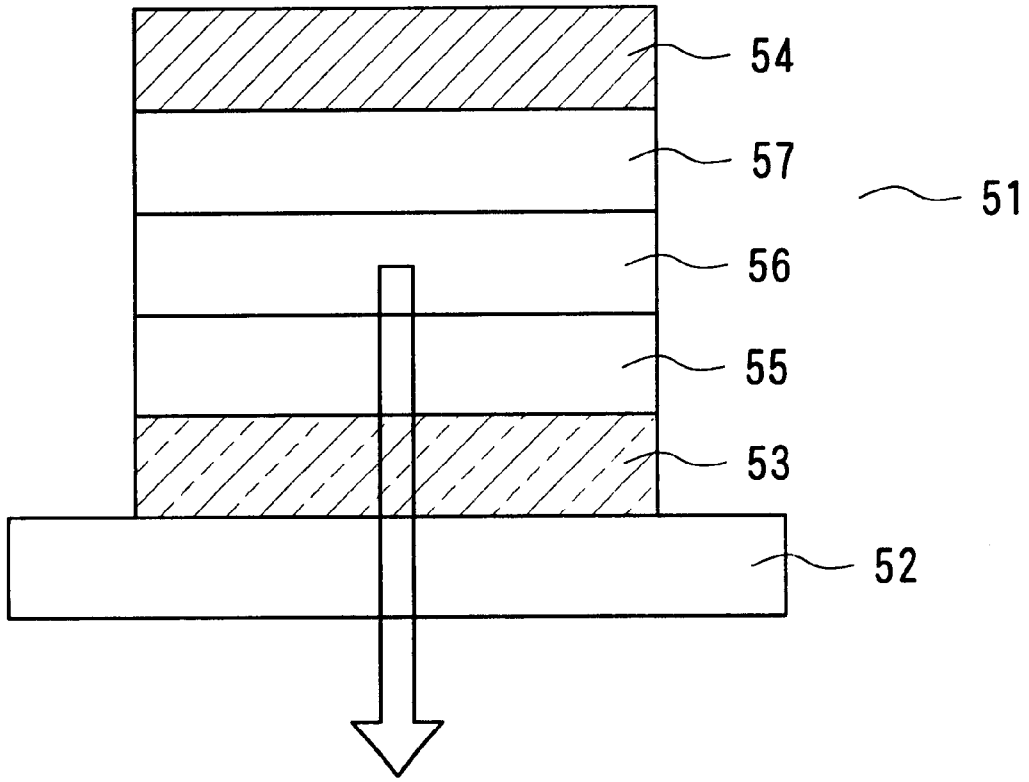
Fig. 1 PRIOR ART
FIG. 1 is a sectional view showing a structure of an organic EL element.

In the pixel portion 1, each pixel comprises a TFT 5 in which a display signal DATA from a data line 3 is applied to a drain and a selection signal SCAN from a selection signal line 4 is applied to a gate, and which is opened and closed according to the selection signal SCAN, an EL element 6 having an anode 60 connected to a source of the TFT 5 and a cathode 61 connected to a ground potential, a storage capacitor 7 connected between the source of the TFT 5 and a predetermined dc potential. The EL element 6 has substantially the same structure as that of FIG. 1, in which a hole-transport layer, an emissive layer, and an electron transport layer are sequentially stacked between the anode 60 and the cathode 61.

In the example illustrating this embodiment, 4 bits of digital video data is to be displayed on one pixel.

The driver circuit 2 comprises 4 D-FFs for each data line 3, and includes a data register 8 (801, 802 . . . ) for receiving input digital data D0 to D3, a shift register 9 for outputting a shift clock SF1, SF2, . . . indicating a timing at which the data register receives data for each data line, a latch circuit 10 for latching the data captured in the data registers 8 according to a latch pulse LAT, and 4 analog switches 120, 121, 122, 123 provided for each data line 3 between a power supply line 11 for supplying a power supply voltage Vdd and the data line 3. 4 bit of output, LD0, LD1, LD2, LD3, from the latch circuit 101 for the data line 3 is input into the 4 analog switches 120, 121, 122, 123, respectively, as a control signal for controlling opening and closing of each switch.

Each of the 4 analog switches 120, 121, 122, 123 comprises an n-channel and p-channel transistors, and the size of the transistors constituting a switch is different for each switch, such that a current of a different amount flows from each switch. Specifically, when the channel width of the transistor constituting the analog switch 120 is W, the channel width of the transistors constituting the analog switches 121, 122, 123 is set to be 2W, 4W, 8W, respectively. Therefore, when a current flowing in the analog switch 120, 121, 122, 123 is set to be $I_0$, $I_1$, $I_2$, $I_3$, respectively, the a current mount for these analog switches can be indicated as $I_1=2I_0$, $I_2=4I_0$, $I_3=8I_0$, respectively.

The operation of the present invention will be described with reference to the timing chart shown in FIG. 5.

Figure 5:
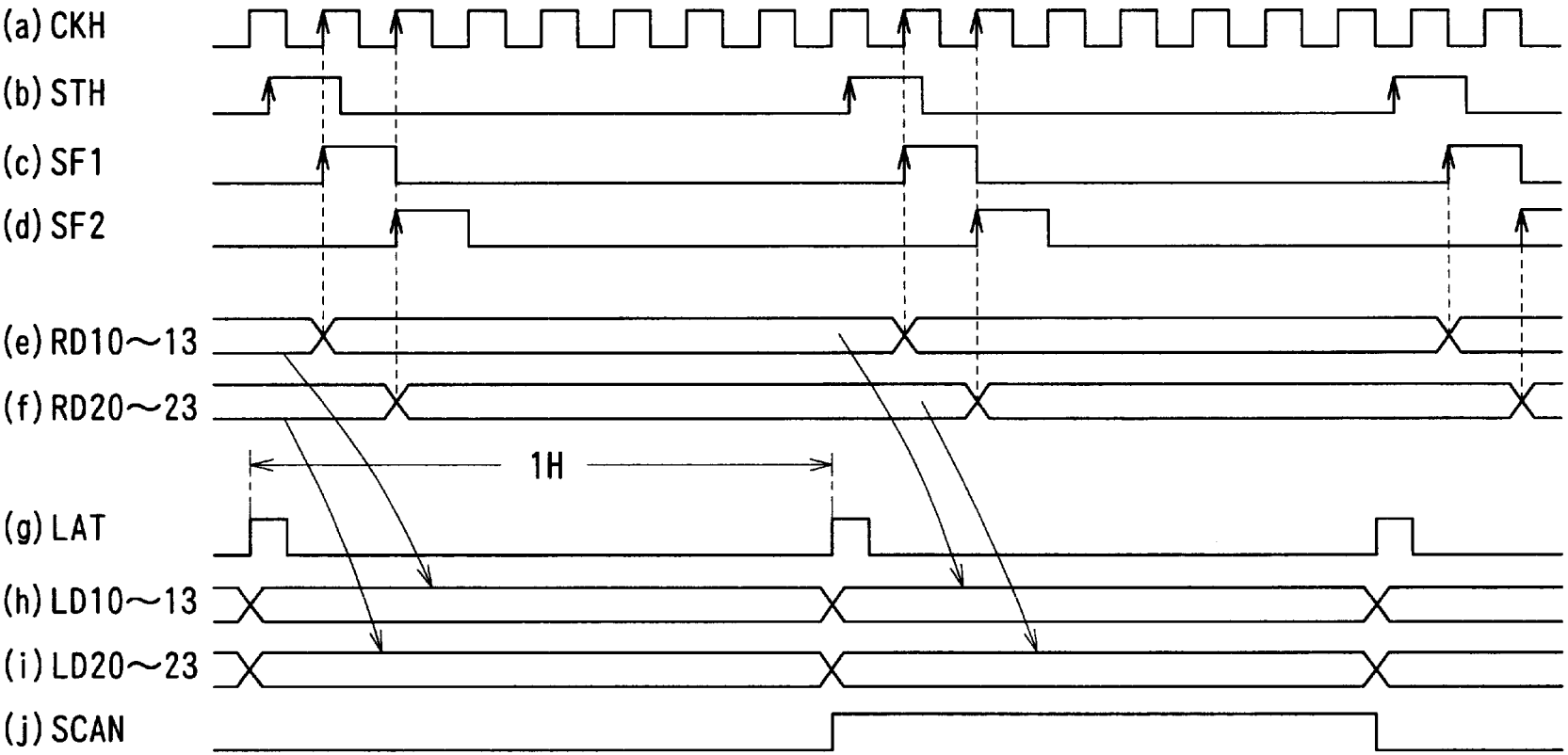
FIG. 5 is a timing chart for explaining the operation of an active type display device according to the present invention.

Initially, when a start pulse STH is rising in the shift register 9 as shown in FIG. 5(*b*), a shift clock SF1, SF2, . . . is sequentially output based on a reference clock CKH from each stage of the shift register 9 during 1 H period (one horizontal synchronizing period). Because the shift clock SF1 for the data line in the first column is applied as a clock to the first stage data register 801, the 4 bit digital video data D0, D1, D2, D3 are supplied and received in the data register 801 according to the rising of the shift clock SF1 as shown in FIG. 5(*e*). The shift clock SF2 for the data line in the second column is applied as a clock into the next stage data register 802, and therefore the 4 bit digital video data D0, D1, D2, D3 are supplied and received in the data register 802 according to the rising of the shift clock SF2 as shown in FIG. 5(*f*). Similarly, the input data D0 to D3 are sequentially captured in the same manner into the data register 8 for the data line in each column.

A latch pulse LAT is output only once during 1 H period, as shown in FIG. 5(*g*). Therefore, in all of the latch circuits 101, 102, . . . , the data D0 to D3 sequentially received into the data register 8 during 1 H period are simultaneously latched and held for 1 H period.

Then, 4 bits of output LD10, LD11, LD12, LD13 from the latch circuit 101 is input to the analog switches 120, 121, 122, 123, respectively. For example, when the output LD10, LD11, LD12, LD13 is "1,0,0,0", respectively, only the analog switch 120 is activated on such that a current $I_0$ flows into the data line 3 as It. At this time, when a selection signal SCAN is at an H level as shown in FIG. 5(*j*), the TFT 5 is switched on to cause the current $I_0$ to flow in the EL element 6, which then emits light with a luminance in accordance with the current $I_0$. Further, when the output LD10, LD11, LD12, LD13 is "1,1,1,1", respectively, all the analog switches 120 to 123 are activated on such that a total current It of the current $I_0$, $I_1$, $I_2$, and $I_3$, namely $It=I_0+2I_0+4I_0+8I_0=15I_0$, flows into the data line 3. Namely, a current 15 times as large as $I_0$ flows into the EL element 6 via the TFT 5 such that EL element 6 emits light with a luminance 15 times that of the foregoing example.

In this manner, display by the EL element is carried out with 16 gray scale luminance corresponding to 4 bit digital video data.

In this embodiment, 4 analog switches are provided for each data line because the bit number of the digital video data is 4. For a different bit number (n) of digital video data, a number (n) of analog switches equal to the bit number may be provided for each data line. Further, the channel width W of each transistor is set to be different so as to vary the current amount of each analog switch in the foregoing example. Alternatively, it is also possible to set the channel length L of the analog switches 120, 121, 122, 123 to 8L, 4L, 2L, L, respectively, or vary both the channel width W and the channel length L.

It is also possible to form the driver circuit as an IC rather than integrating it on the same substrate. In this structure, as in the foregoing example, it is not necessary to provide input terminals for inputting a gray scale voltage so as to convert digital video data into a corresponding voltage signal and the wiring pattern for the terminals.

Figure 2:
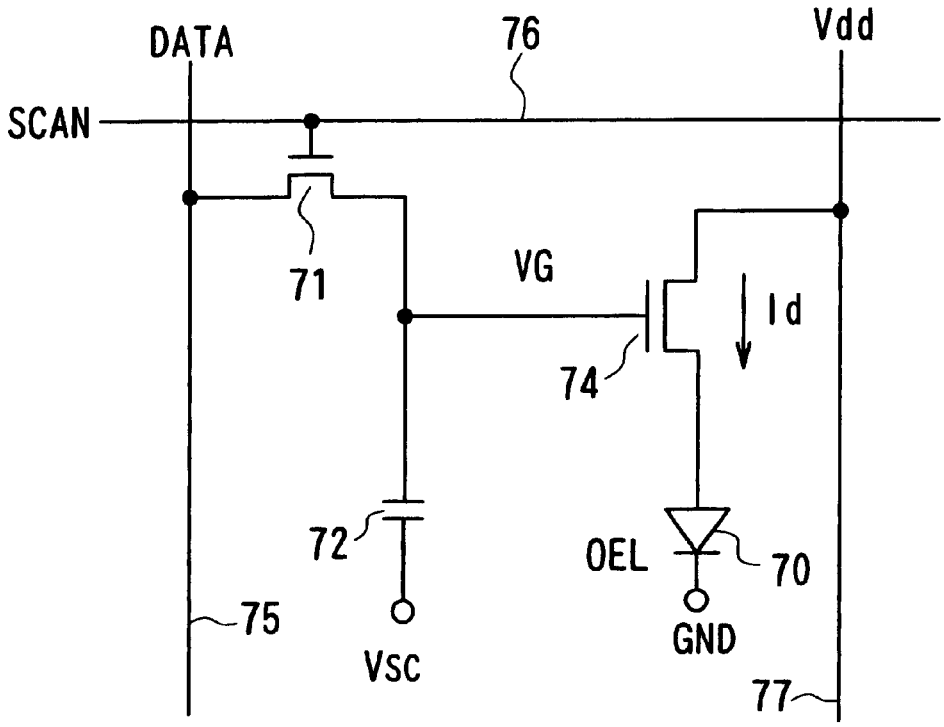
Fig. 2 PRIOR ART
FIG. 2 is a diagram showing a circuit structure corresponding to one pixel of an active type display device according to a related art.
Figure 3:
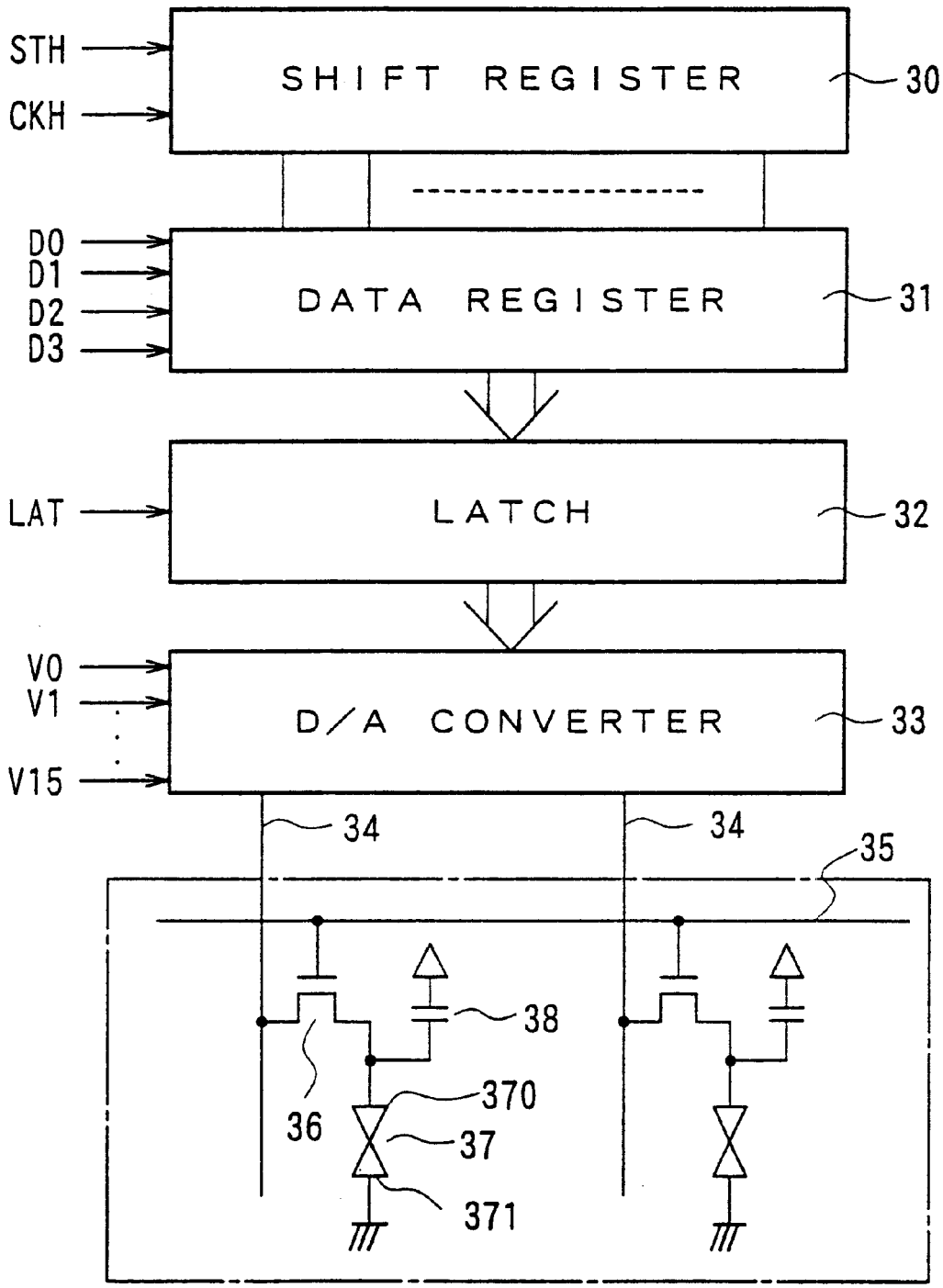
Fig. 3 PRIOR ART
FIG. 3 is a block diagram showing an active type liquid crystal display device according to a related art.

In the foregoing example, each pixel comprises one TFT (5) with regard to one OEL (6). However, it is also possible to drive an OEL in a pixel comprising two TFTs with regard to the one OEL as shown in FIG. 2, by the above drive circuit, particularly by a circuit structure in which a current signal according to the digital data is output by n analog switches provided for each data line. In this case, a data current signal supplied from the data line to the capacitor 72 via the TFT 71 is accumulated, and the TFT 74 is controlled according to the accumulated charge amount to supply a current to the OEL according to the digital data.

While the preferred embodiments of the present invention have been described using specific terms, such description is for illustrative purposes only, and it is to be understood that changes and variations may be made without departing from the spirit or scope of the appended claims.

What is claimed is:

1. An active matrix type emissive display device including, for each pixel, a thin film transistor to be opened and closed according to a selection signal and an emissive element connected to a data line via said thin film transistor for emitting light according to a supplied current, said device comprising n transistors for receiving, bit by bit, n bit input digital data sequentially captured for each data line and respectively outputting a different amount of electrical current, wherein a current signal corresponding to a total current amount from said n transistors is output to a corresponding data line and is supplied to said emissive element via said thin film transistor.

2. A display device according to claim 1, wherein each of said n transistors is of a different size.

3. A display device according to claim 1, wherein said emissive element is an organic electroluminescence element comprising an emissive layer containing an organic compound between an anode and a cathode.

4. A display device according to claim 3, wherein said n transistors for outputting said current signal are formed on a substrate on which said organic electroluminescence element and said thin film transistor are also formed.

5. An active matrix type electroluminescence display device comprising:

an electroluminescence element connected to a data line via a thin film transistor to be opened and closed according to a selection signal, a data register for sequentially capturing input digital data for each data line, a latch circuit for holding the data received by said data register for a predetermined period, and n switches, n being an integer value greater than or equal to 2, to which n bit of digital data for each data line is input bit by bit as a control signal, each of said n switches supplying a different amount of electrical current.

6. A display device according to claim 5, wherein the size of each of transistors constituting said n switches is of a different size.

7. A display device according to claim 5, wherein said electroluminescence element is an organic electroluminescence element comprising an emissive layer containing an organic compound between an anode and a cathode.

8. A display device according to claim 7, wherein said n transistors for outputting said current signal are formed on a substrate on which said organic electroluminescence element and said thin film transistor are also formed.

9. A driver circuit for an electroluminescence display device including, for each pixel, a thin film transistor to be opened and closed according to a selection signal and an electroluminescence element connected to a data line via said thin film transistor for emitting light according to supplied electrical current, said driver circuit comprising n transistors for receiving, bit by bit, n bit input digital data sequentially captured for each data line and respectively outputting a different amount of electrical current, wherein a signal corresponding to total electrical current from said n transistors is output to a corresponding data line.

10. A driver circuit according to claim 9, further comprising:

a data register for sequentially capturing input digital data for each data line; and a latch circuit for holding the data captured by said data register for a predetermined period, wherein said n transistors are provided between said data line and a power supply line to output a current signal by receiving, bit by bit, n bit digital data for each one data line from said latch circuit.

11. A driver circuit according to claim 10, wherein each of said n transistors is of a different size.

12. A driver circuit according to claim 10, wherein said electroluminescence element is an organic electroluminescence element comprising an emissive layer containing an organic compound between an anode and a cathode.

13. A driver circuit according to claim 12, wherein said n transistors for outputting said current signal are formed on a substrate on which said organic electroluminescence element and said thin film transistor are also formed.

* * * * *